US009215787B2

(12) United States Patent
Hung

(10) Patent No.: US 9,215,787 B2
(45) Date of Patent: Dec. 15, 2015

(54) LIGHT DEVICE WITH REMOTE FUNCTION

(71) Applicant: BESPARK LED CORPORATION, Taichung (TW)

(72) Inventor: Chih-Ming Hung, Taichung (TW)

(73) Assignee: BESPARK LED CORPORATION, Taichung (TW)

( * ) Notice: Subject to any disclaimer, the term of this patent is extended or adjusted under 35 U.S.C. 154(b) by 158 days.

(21) Appl. No.: 14/148,480

(22) Filed: Jan. 6, 2014

(65) Prior Publication Data

US 2014/0204583 A1 Jul. 24, 2014

(30) Foreign Application Priority Data

Jan. 21, 2013 (TW) ..... 102201272 U
Jan. 21, 2013 (TW) ..... 102201273 U

(51) Int. Cl.
*F21V 9/00* (2015.01)
*H05B 37/02* (2006.01)

(52) U.S. Cl.
CPC ..... *H05B 37/0272* (2013.01)

(58) Field of Classification Search
CPC .... H05B 37/02; H05B 37/0272; H05B 43/00; H05B 41/14; H05B 39/06
USPC ..... 362/233, 249.02
See application file for complete search history.

(56) References Cited

U.S. PATENT DOCUMENTS 6,037,721 A * 3/2000 Lansing et al. ..... 315/295
6,965,205 B2 * 11/2005 Piepgras et al. ..... 315/318
2006/0097660 A1 * 5/2006 Scott et al. ..... 315/291

* cited by examiner

*Primary Examiner* — Ali Alavi
(74) *Attorney, Agent, or Firm* — Muncy, Geissler, Olds & Lowe, P.C.

(57) ABSTRACT

A light device with remote function includes a remote controller and a light stick. When the remote controller is switched on, the remote controller transmits a control message to the light stick, wherein one lighting mode datum is attached to the control message; the light stick lights according to one lighting mode which corresponds to one lighting mode datum. Therefore, when there are many users with light sticks in a large concert, the light sticks of the users are all controlled by only one remote controller; therefore, the lighting modes of the light sticks are the same as each other; in other words, a light effect in front of a stage would be performed uniformly.

8 Claims, 4 Drawing Sheets

LIGHT DEVICE WITH REMOTE FUNCTION

BACKGROUND OF THE INVENTION

1. Field of the Invention

The present invention relates to a light device, and more particularly to a light device with remote function.

2. Description of the Prior Art

Referring to FIG. 4, a conventional light device comprises a light stick 90 and a mode button 91. The light stick 90 has a light source assembled thereon. The mode button 91 is configured for a user to select one light mode. Therefore, the light mode of the conventional light device is changeable.

However, the conventional light device has one disadvantage as following:

When there are many users with light sticks in a large concert, each light stick is controlled by each user; therefore, the lighting modes of the light sticks are different from each other; in other words, a light effect in front of a stage would not be performed uniformly.

The present invention is, therefore, arisen to obviate or at least mitigate the above mentioned disadvantages.

SUMMARY OF THE INVENTION

An object of the present invention is to provide a light device.

To achieve the above and other objects, a light device with remote function comprises a remote controller having a transmitting device, a first processor and a switch unit, the first processor having a store memory, a plurality of lighting mode data stored in the store memory, each lighting mode datum corresponding to each corresponding lighting mode of the light stick, the transmitting device transmitting a control message, wherein when the remote controller is switched on via the switch unit, the transmitting device transmits the control message to the light stick, wherein one lighting mode datum is attached to the control message; the light stick lights according to one lighting mode which corresponds to one lighting mode datum; and a light stick having a stick body, the stick body having at least one light unit assembled therein, a color of the light unit being changeable, the stick body further having a control circuit assembled therein, the stick body having a positioning board assembled therein, the light unit positioned on the positioning board, the control circuit having a second processor, a driving module, a receiving module, a quartz oscillator, a mode button and a switch member, the receiving module having an aerial which is positioned on the positioning board, the aerial configured to receive the control message from the remote controller, the quartz oscillator transforming the control message into an instructing message, the driving module receiving the instructing message, the driving module driving the light unit to light according to one lighting mode. Wherein, there is a plurality of light units; the driving module drives the light units to light, wherein the colors of the light units are different from each other so as to make a blended light effect; when the remote controller is switched on via the switch unit, only the remote controller is capable of controlling the lighting modes of the light stick; the mode button of the light stick loses efficacy; the second processor has a store memory; a plurality of lighting mode data is stored in the store memory; each lighting mode datum corresponds to each corresponding lighting mode of the light stick; the remote controller has a plurality of mode keys assembled thereon; each mode key corresponds to each corresponding lighting mode datum; when a user wants to select one lighting mode corresponding to one lighting mode datum, the user manually press one corresponding mode key; the remote controller has a socket assembled thereon; the socket is configured to receive a further control message; the transmitting device transmits the further control message to the receiving module; the light unit is a light emitting diode; the aerial is assembled in the positioning board.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
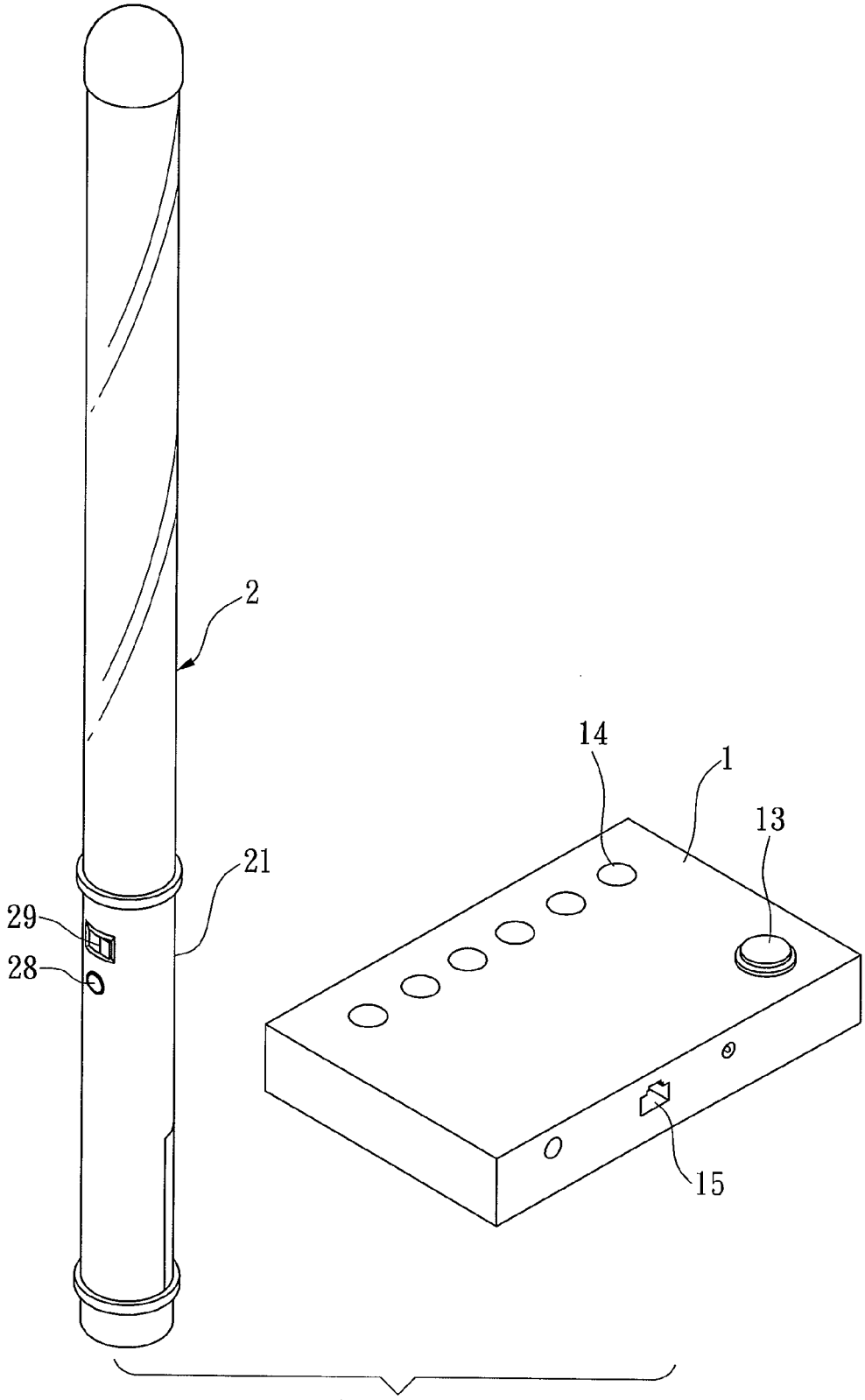
FIG. 1 is a perspective view of the present invention.
Figure 2:
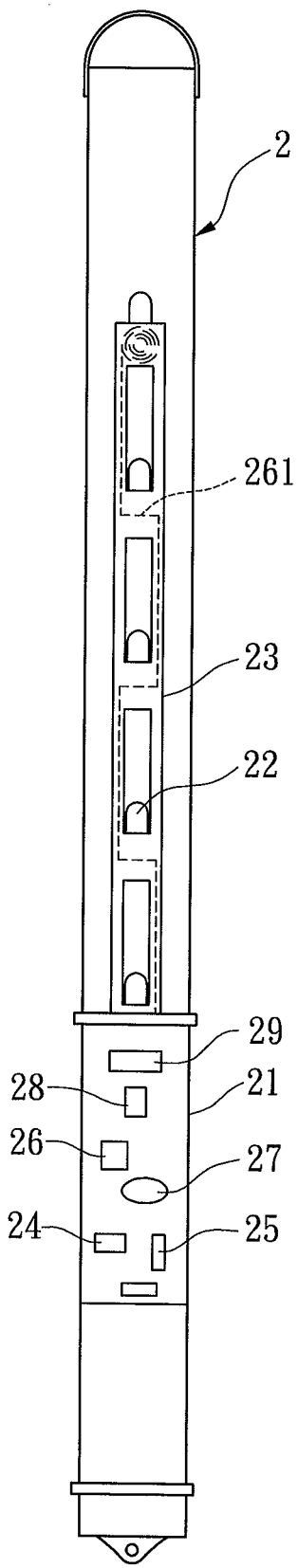
FIG. 2 is a side view of a light stick.
Figure 3:
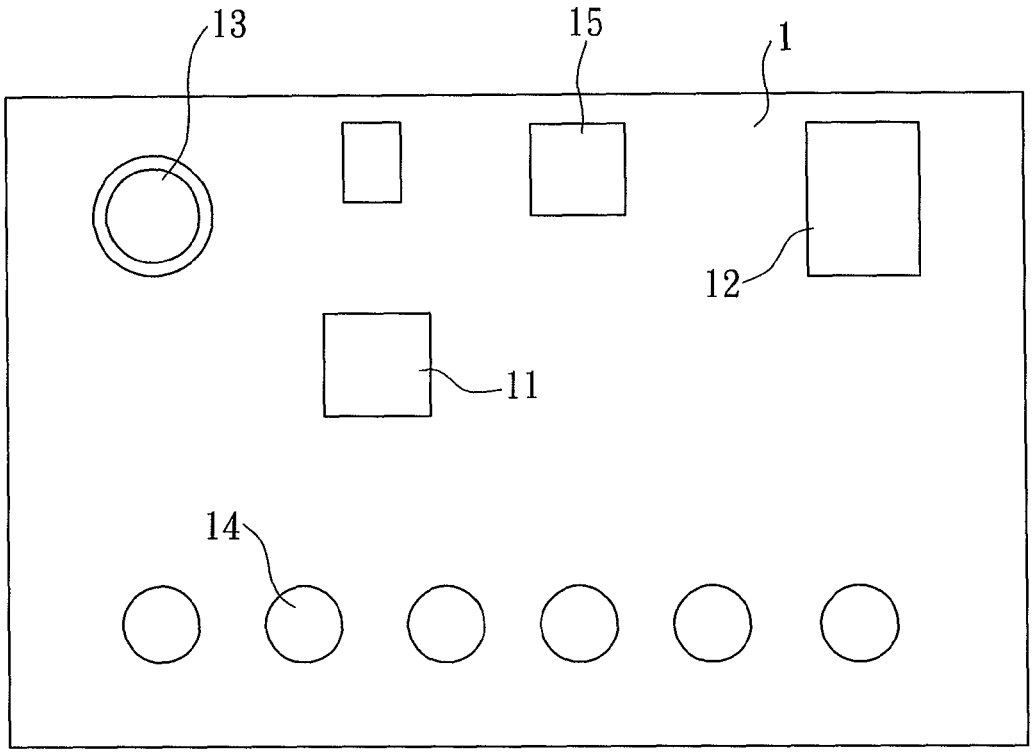
FIG. 3 is an illustrating diagram of a remote controller.
Figure 4:
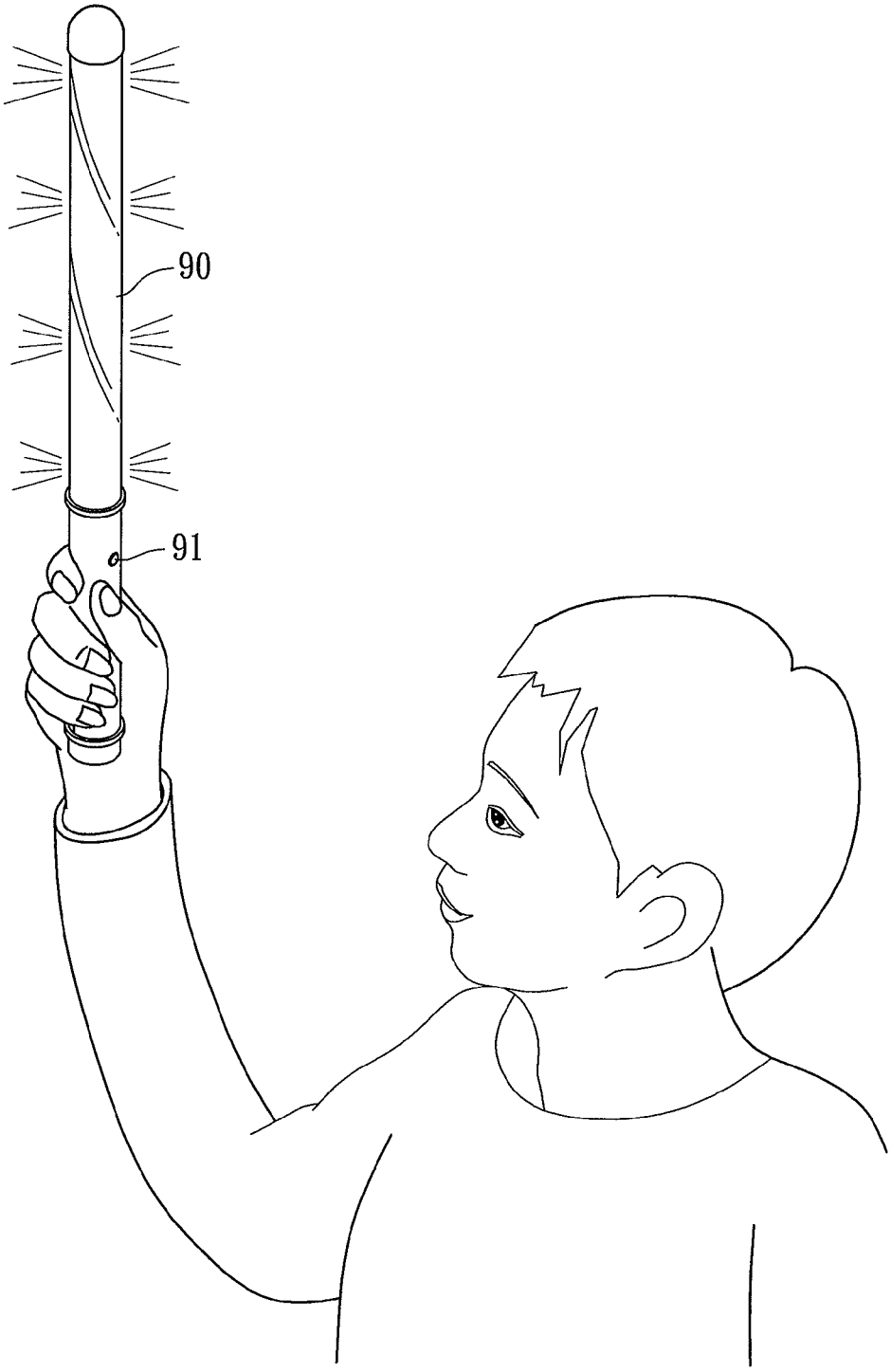
FIG. 4 PRIOR ART
FIG. 4 is a perspective view of the convention.

Referring to FIGS. 1-3, a light device with remote function in accordance with the present invention comprises a remote controller 1 and a light stick 2. The remote controller 1 controls lighting modes (such as changing color or twinkling) of the light stick 2. The remote controller 1 has a transmitting device 11, a first processor 12 and a switch unit 13. The transmitting device 11 transmits a control message. The first processor 12 has a store memory (not shown). A plurality of lighting mode data is stored in the store memory. Each lighting mode datum corresponds to each corresponding lighting mode of the light stick 2. When the remote controller 1 is switched on via the switch unit 13, the transmitting device 11 transmits the control message to the light stick 2, wherein one lighting mode datum is attached to the control message; the light stick 2 lights according to one lighting mode which corresponds to one lighting mode datum. The light stick 2 comprises a stick body 21. The stick body 21 has at least one light unit 22 assembled therein (there are four light units 22 in this embodiment.). The light unit 22 is illustrated as a light emitting diode. A color of the light unit 22 is changeable. The stick body 21 further has a control circuit assembled therein. The stick body 21 has a positioning board 23 assembled therein. The light unit 22 is positioned on the positioning board 23. The control circuit has a second processor 24, a driving module 25, a receiving module 26, a quartz oscillator 27, a mode button 28 and a switch member 29. The receiving module 26 has an aerial 261 which is positioned on or assembled in the positioning board 23. The aerial 261 is configured to receive the control message from the remote controller 1. The quartz oscillator 27 transforms the control message into an instructing message; thereafter, the driving module 25 receives the instructing message; as a result, the driving module 25 drives the light unit 22 to light according to one lighting mode.

In this embodiment, the driving module 25 drives the four light units 22 to light, wherein four colors of the four light units 22 are different from each other so as to make a blended light effect. The second processor 24 has a store memory (not shown). A plurality of lighting mode data is stored in the store memory. Each lighting mode datum corresponds to each corresponding lighting mode of the light stick 2.

The remote controller 1 has a plurality of mode keys 14 assembled thereon. Each mode key 14 corresponds to each corresponding lighting mode datum. When a user wants to select one lighting mode corresponding to one lighting mode datum, the user needs to manually press one corresponding mode key 14. The remote controller 1 has a socket 15 assembled thereon. The socket 15 is configured to receive a further control message from an external apparatus. The transmitting device 11 transmits the further control message to the receiving module 26.

The user can switch the light stick 2 on via pressing the switch member 29. When the user wants to select one lighting mode corresponding to one lighting mode datum, the user needs to manually press the mode button 28 so as to select the corresponding lighting mode datum.

When the remote controller 1 is switched on via the switch unit 13, the mode button 28 of the light stick 2 loses efficacy; in other words, only the remote controller 1 is capable of controlling the lighting modes of the light stick 2.

All in all, the present invention has one advantage as following:

When there are many users with light sticks in a large concert, the light sticks of the users are all controlled by only one remote controller; therefore, the lighting modes of the light sticks are the same as each other; in other words, a light effect in front of a stage would be performed uniformly.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A light device with remote function comprising:

a remote controller having a transmitting device, a first processor and a switch unit, the first processor having a store memory, a plurality of lighting mode data stored in the store memory, each lighting mode datum corresponding to each corresponding lighting mode of the light stick, the transmitting device transmitting a control message, wherein when the remote controller is switched on via the switch unit, the transmitting device transmits the control message to the light stick, wherein one lighting mode datum is attached to the control message; the light stick lights according to one lighting mode which corresponds to one lighting mode datum; and a light stick having a stick body, the stick body having at least one light unit assembled therein, a color of the light unit being changeable, the stick body further having a control circuit assembled therein, the stick body having a positioning board assembled therein, the light unit positioned on the positioning board, the control circuit having a second processor, a driving module, a receiving module, a quartz oscillator, a mode button and a switch member, the receiving module having an aerial which is positioned on the positioning board, the aerial configured to receive the control message from the remote controller, the quartz oscillator transforming the control message into an instructing message, the driving module receiving the instructing message, the driving module driving the light unit to light according to one lighting mode.

2. The light device with remote function as claimed in claim 1, wherein there is a plurality of light units; the driving module drives the light units to light, wherein the colors of the light units are different from each other so as to make a blended light effect.

3. The light device with remote function as claimed in claim 1, wherein when the remote controller is switched on via the switch unit, only the remote controller is capable of controlling the lighting modes of the light stick; the mode button of the light stick loses efficacy.

4. The light device with remote function as claimed in claim 1, wherein the second processor has a store memory; a plurality of lighting mode data is stored in the store memory; each lighting mode datum corresponds to each corresponding lighting mode of the light stick.

5. The light device with remote function as claimed in claim 1, wherein the remote controller has a plurality of mode keys assembled thereon; each mode key corresponds to each corresponding lighting mode datum; when a user wants to select one lighting mode corresponding to one lighting mode datum, the user manually press one corresponding mode key.

6. The light device with remote function as claimed in claim 1, wherein the remote controller has a socket assembled thereon; the socket is configured to receive a further control message; the transmitting device transmits the further control message to the receiving module.

7. The light device with remote function as claimed in claim 1, wherein the light unit is a light emitting diode.

8. The light device with remote function as claimed in claim 1, wherein the aerial is assembled in the positioning board.

* * * * *